United States Patent [19]

Shirley-Fisher

[11] Patent Number: 4,928,777

[45] Date of Patent: May 29, 1990

[54] CUTTING ELEMENTS FOR ROTARY DRILL BITS

[75] Inventor: David N. Shirley-Fisher, Cheltenham, England

[73] Assignee: NL Petroleum Products Limited, Gloucestershire, England

[21] Appl. No.: 120,718

[22] Filed: Nov. 5, 1987

Related U.S. Application Data

[63] Continuation of Ser. No. 808,325, Dec. 12, 1985, abandoned.

[30] Foreign Application Priority Data

Dec. 22, 1984 [GB] United Kingdom ..... 8432587

[51] Int. Cl.[5] ..... E21B 10/46

[52] U.S. Cl. ..... 175/329; 175/410; 407/118

[58] Field of Search ..... 175/329, 410, 379, 383, 175/412, 413, 421; 407/114, 119, 118

[56] References Cited

U.S. PATENT DOCUMENTS

| | | | |
|---|---|---|---|
| 744,763 | 11/1903 | Karns | 175/413 X |
| 1,077,772 | 11/1913 | Weathersby | 175/413 |
| 1,923,488 | 8/1933 | Howard et al. | 175/410 |
| 3,145,790 | 8/1964 | Bridwell et al. | 175/413 X |
| 3,301,339 | 1/1967 | Pennebaker, Jr. | 175/410 X |
| 4,156,329 | 5/1979 | Daniels et al. | 175/329 |
| 4,373,593 | 2/1983 | Phaal et al. | 175/329 |
| 4,481,016 | 11/1984 | Campbell et al. | 51/295 |
| 4,572,713 | 2/1986 | Schmidt | 407/114 |

FOREIGN PATENT DOCUMENTS

| | | | |
|---|---|---|---|
| 980799 | 1/1965 | United Kingdom | 175/329 |
| 2054427 | 2/1981 | United Kingdom | 407/114 |

OTHER PUBLICATIONS

"Stratapax Drill Blanks", General Electric Co., Oct. 18, 1982, 2 pages.

*Primary Examiner*—Hoang C. Dang
*Attorney, Agent, or Firm*—Browning, Bushman, Anderson & Brookhart

[57] ABSTRACT

A cutting element, for a rotary drill bit, comprises a tablet having a front face, a rear face and a peripheral edge, at least the front face of the tablet being provided by a layer of superhard material, such as polycrystalline diamond. The peripheral edge of the tablet is formed with one or more re-entrant portions so as to define projecting cutting portions to the sides of the re-entrant portions. The element may be cut from a blank which is initially circular.

8 Claims, 4 Drawing Sheets

CUTTING ELEMENTS FOR ROTARY DRILL BITS

This is a continuation of co-pending application Ser. No. 808,325 filed on December 12, 1985 now abandoned.

BACKGROUND OF THE INVENTION

The invention relates to cutting elements for rotary drill bits for use in drilling or coring deep holes in subsurface formations.

Rotary drill bits of the kind to which the present invention is applicable comprise a bit body having a shank for connection to a drill string and an inner channel for suplying drilling fluid to the face of the bit. The bit body carries a plurality of so-called 'preform' cutting elements. Each cutting element may be mounted directly on the bit body or on a carrier, such as a stud or post, which is received in a socket in the bit body. One common form of perform cutting element comprises a tablet having a hard facing layer of polycrystalline diamond or other superhard material and a backing layer formed of cemented tungsten carbide. The two-layer arrangement of the cutting element provides a degree of self sharpening since, in use, the less hard backing layer wears away more easily than the harder cutting layer. Another form of cutting element comprises a single unitary tablet of thermally stable polycrystalline diamond material.

The perform cutting elements, which are formed under massive pressure in a press, are most often in the form of circular discs and are mounted on the drill bit so that, in use, each element wears away along one portion of its peripheral edge. However, other configurations of cutting element are known, for example sectorshaped, equare and triangular elements, where the cutting action is performed by a projecting angular portion of the cutting element.

Conventional cutting elements of the kind described may not, however, provide the best cutting effect on certain types of formation being drilled, and the present invention sets out to provide an improved form of cutting element which is straightforward to manufacture and which may give more rapid drilling with some types of formation.

SUMMARY OF THE INVENTION

According to the invention, there is provided a cutting element, for a rotary drill bit, comprising a tablet having a front face, a rear face and a peripheral edge, at least the front face of the tablet being provided by a layer of superhard material, and the peripheral edge of the tablet being formed with at least one re-entrant portion so as to define a projecting cutting portion to at least one side of the re-entrant portion.

The tablet may comprise a front cutting layer of superhard material, such as polycrystalline diamond, bonded to a less hard backing layer, the superhard material defining the front face of the tablet and the backing layer defining the rear face of the tablet. Alternatively, the tablet may comprise a single unitary layer of superhard material, such as polycrystalline diamond, which defines both the front face and the rear face of the tablet.

There may be provided a projecting cutting element at each side of each re-entrant portion, thereby to provide at least two projecting cutting portions. Alternatively there may be provided two re-entrant portions which define between them a single cutting portion.

The tablet may be formed, along a part of the peripheral edge thereof, with a plurality of alternate re-entrant and projecting portions so as to provide three or more projecting portions. The extremities of all the projecting cutting portions may lie on a substantially straight line so that, in use of the cutting element, they act simultaneously on the formation being drilled. Alternatively, the extremities of only some of the projecting portions may lie on a substantially straight line, the extremities of at least one other projecting portion being displaced from said straight line. With such an arrangement only some of the projecting portions will act on the formation initially, and the other projecting portions will only be brought into use when the first portions have been worn down to their level. This may thus increase the overall effective life of the cutting element.

The periphery of the cutting element, apart from said re-entrant portion or portions, may be part-circular in configuration.

The tablet may be in the form of a section of an annulus, having a concavely curved edge portion and an opposite, concentric, convexly curved edge portion. The opposite concavely and convexly curved edge portions may be connected by two substantially straight opposite edge portions which extend substantially radially with respect to the annulus.

The invention includes within its scope a cutting assembly, for use on a drill bit, comprising a cutting element according to the invention mounted on a carrier, such as a stud or post. The invention also includes a rotary drill bit having mounted thereon a plurality of cutting elements according to the invention.

The invention also provides a method of forming a cutting element of any of the kinds referred to above, which method comprises forming in a forming press a preform blank, the periphery of which has no re-entrant portions, and then subsequently cutting into the preform blank at least one re-entrant portion so as to define a projecting cutting portion at each side of the re-entrant portion.

The cutting of the preform blank may be effected by electric discharge machining or by a laser, or by any other suitable method.

The method may comprise cutting into the preform blank a plurality of alternate re-entrant and projecting portions.

In the case where the blank is substantially symmetrical, the alternate re-entrant and projecting portions may be cut across the centre of the blank so as to form from the blank two essentially similar cutting elements.

Alternatively, also when the blank is substantially symmetrical, it may be cut into four substantially similar segments the lines of cut also forming each segment with at least one re-entrant portion so as to define a projecting cutting portion at each side of the re-entrant portion.

In any of the above arrangements the preform blank may be substantially circular before being cut. the method may include the steps of cutting from the circular preform blank a central concentric portion of smaller diameter to leave an annular blank, and then cutting the annular blank into sections, each cut extending from the inner peripheral edge of the blank to the outer peripheral edge thereof. The annular blank may be cut into sections by a plurality of substantially radially extending cuts.

The following is a more detailed description of embodiments of the invention.

DETAILED DESCRIPTION OF PREFERRED EMBODIMENTS

Figure 1:
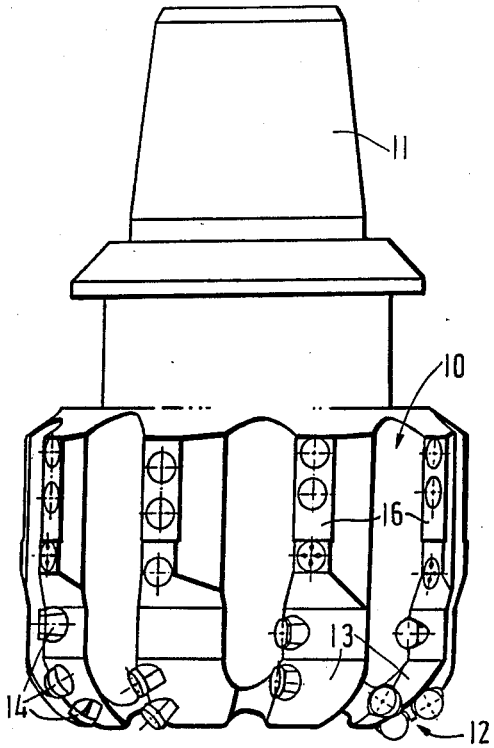
FIG. 1 is a side elevation of a typical drill bit in which cutting elements according to the invention may be used.
Figure 2:
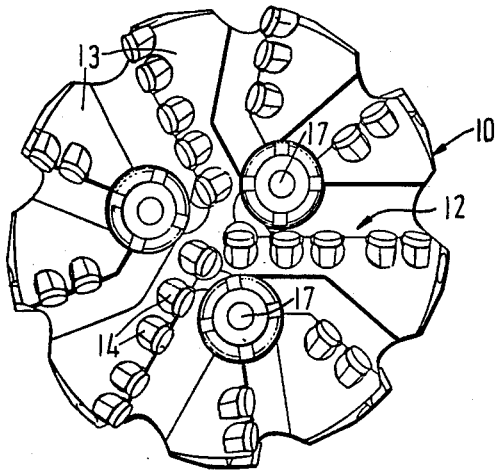
FIG. 2 is an end elevation of the drill bit shown in FIG. 1.

FIGS. 1 and 2 show a typical full bore drill bit of a kind to which cutting elements of the present invention are applicable.

The bit body 10 is typically formed of tungsten carbide matrix infiltrated with a binder alloy, and has a threaded shank 11 at one end for connection to the drill string.

The operative end face 12 of the bit body is formed with a number of blades 13 radiating from the central area of the bit, and the blades carry cutting members 14 spaced apart along the length thereof.

The bit has a gauge section including kickers 16 which contact the walls of the bore hole to stabilise the bit in the bore hole. A central channel (not shown) in the bit body and shank delivers drilling fluid through nozzles 17 in the end face 12 in known manner.

Each cutting member 14 comprises a preform cutting element mounted on a carrier in the form of a stud which is located in a socket in the bit body. Conventionally, each preform cutting element is usually in the form of a circular tablet comprising a thin facing layer of polycrystalline diamond bonded to a backing layer of tungsten carbide, both layers being of uniform thickness. The rear surface of the backing layer of each cutting element is bonded, for example by LS bonding, to a suitably orientated surface on the stud, which may also be formed from tungsten carbide.

It will be appreciated that this is only one example of the many possible variations of the type of bit to which the invention is applicable, including bits where the body is formed from steel, and those where each preform cutting element comprises a unitary tablet of thermally stable polycrystalline diamond material. In some cases the cutting elements may be mounted directly on the bit body insteade of being mounted on studs.

Figure 3:
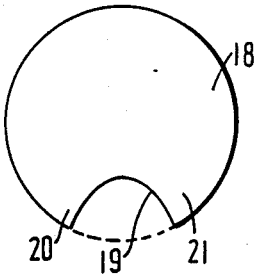
FIGS. 3, 4 and 5 are front elevations of various forms of cutting element in accordance with the invention.

FIG. 3 shows a cutting element according to the invention which is modified from a standard circular preform. According to the invention, the circular tablet-like blank 18 is cut by electric discharge machining or by a laser to form a single re-entrand portion 19 which has the effect of defining, on opposite sides of the re-entrant portion, projecting cutting portions 20 and 21. The cutting element is so mounted on the drill bit that the projecting portions 20 and 21 act on the formation being drilled.

Figure 4:
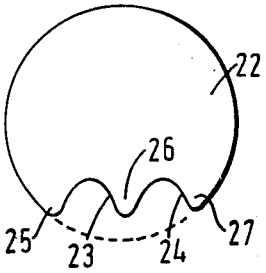

FIG. 4 shows an alternative arrangement whereby a circular blank 22 is formed with two re-entrant portions 23 and 24 to provide three projecting cutting portions 25, 26 and 27. It will be noted that the re-entrant portions 23 and 24 are so formed that the extremities of the projecting portions lie along a substantially straight line so that all the projecting cutting portions act on the formation simultaneously.

Figure 5:
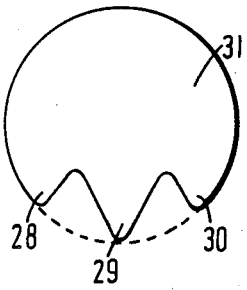

In the alternative arrangement shown in FIG. 5, on the other hand, each cutting portion 28, 29 and 30 extends to the periphery of the circular blank 31 so that the centre projecting portion 29 projects beyond the straight line connecting the extremities of the projecting portions 28 and 30. Consequently, when the cutting element is new only the cutting portion 29 acts on the formation, but after it has worn down the other two cutting portions 28 and 30 are brought into action. This may extend the overall effective life of the cutting element.

Figure 6:
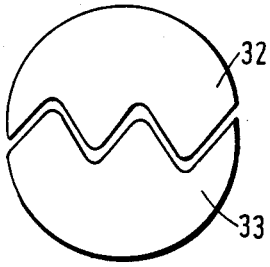
FIG. 6 illustrates a method whereby two cutting elements may be formed from a single preform blank.

The cutting elements shown in FIGS. 3 to 5 are each formed from a single circular preform blank. FIG. 6 shows an arrangement whereby two cutting elements may be formed from a single blank. In this case the blank is cut across its centre along a zig-zag line so as to divide the blank into two similar halves 32 and 33, each half being formed with a plurality of alternating re-entrant portions and projecting cutting portions.

Figure 7:
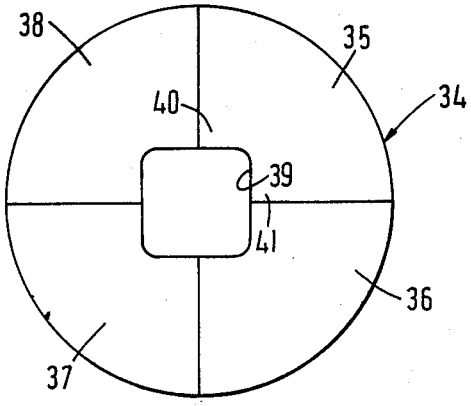
FIG. 7 shows an arrangement whereby four cutting elements may be formed from a single blank.

In the arrangements of FIGS. 3 to 6 the circular blank from which the cutting elements are formed may be of the conventional diameter of the normal circular cutting element. FIG. 7 shows how a larger diameter circular element 34 (for example 34 mm in diameter) may be divided to form four generally sector-shaped cutting elements 35, 36, 37 and 38. The angular portion of each sector is cut to form a re-entrant portion, such as indicated at 39, and thus provides each cutting element with projecting cutting portions 40, 41.

It will be appreciated that arrangements of the kind shown in FIGS. 6 and 7 make the maximum use of the preform material. The opposite surfaces of the cutting elements may be generally flat, in conventional manner, but the invention also includes within its scope arrangements where one or both surfaces of each cutting element are convex or concave.

Although in all the examples described in detail the basic preform blank is circular, it will be appreciated that the invention is equally applicable to the use of preforms of other configurations, such as rectangular or triangular preforms, the essential feature of the invention being that the preforms are modified by cutting at least one re-entrant portion to form one or more projecting cutting portions.

Other arrangements according to the invention are shown in FIGS. 8 to 12. In each case the basic preform blank is circular, and the portion which is removed from the blank to produce the finished cutter is cross-hatched.

Figure 10:
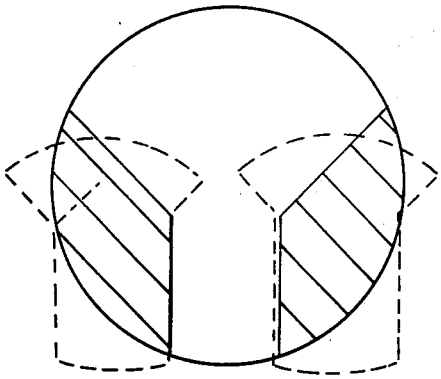
FIGS. 8 to 13 show other forms of cutting element in accordance with the invention.
Figure 11:
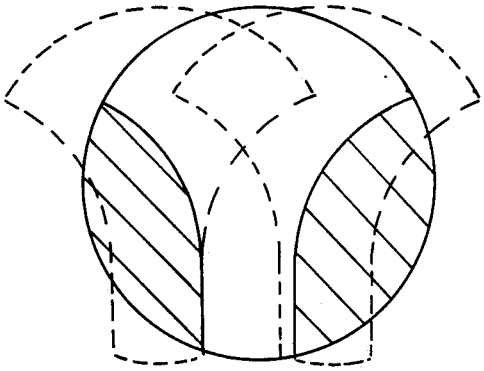
Figure 9:
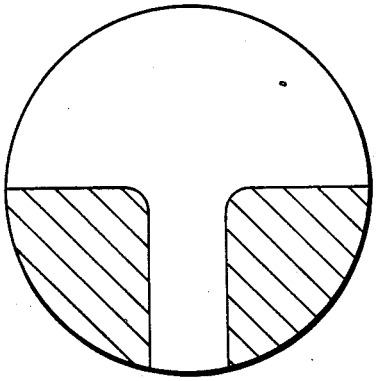

In the arrangements of FIGS. 9 to 11, the sides of the projecting cutting portion are substantially parallel so that the cutting element does not increase significantly in width as it wears down during use. This is advantageous since it means that the rubbing area of the cutting element on the formation does not increase with wear, which would otherwise increase resistance to rotation of the bit as well as impairing the effectiveness of the cutting elements.

Figure 12:
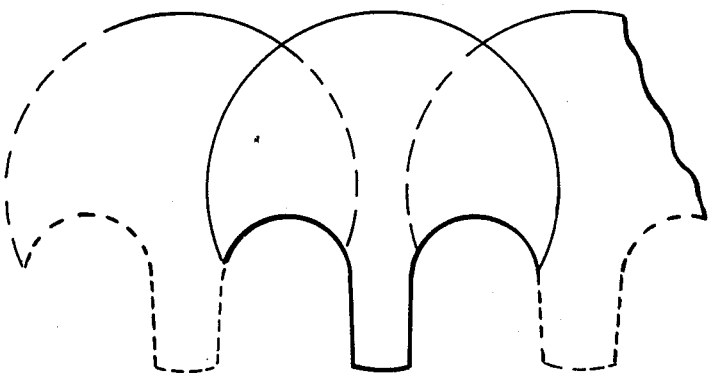
Figure 8:
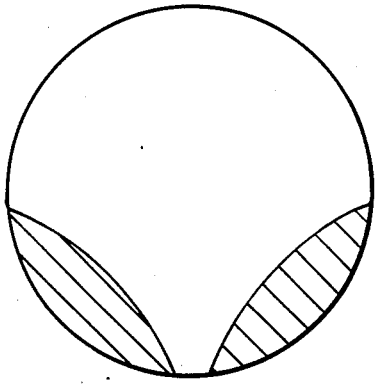

In FIGS. 10, 11 and 12 there are also shown, in dotted lines, the relative positions of cutting elements on different portions of the surface of the bit body, as viewed in the direction of cutting movement of the elements. It will thus be seen that the paths swept by the cutting elements are immediately adjacent or overlap to ensure removal of formation over a continuous area. The arrangement may be such, as shown in FIGS. 10 and 11, that a cutter slightly overlaps the path of the next cutter on one side but does not overlap the path of the cutter on the other side.

Figure 13:
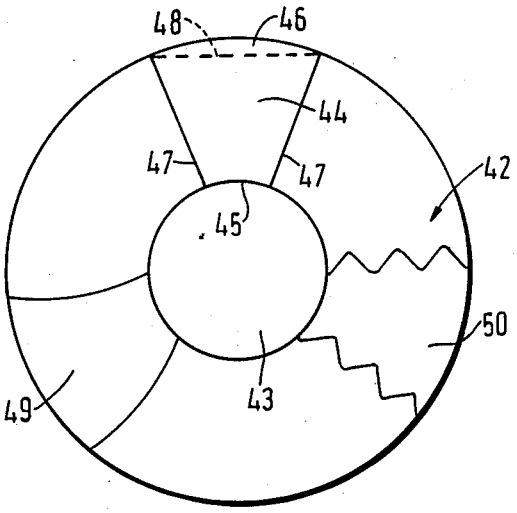

FIG. 13 illustrates a method whereby a number of cutting elements in accordance with the invention may be cut from a single large circular blank.

Conventionally circular polycrystalline diamond cutting elements have been produced, in the forming press, to the diameters required for use on drill bits, for example 13.3 mm or larger. However, forming presses are now in use which can produce much larger diameter preforms, for example up to 50 mm diameter or even larger. Such large diameter preforms may be cheaper to produce per unit area than smaller diameter preforms. It is therefore known to reduce the cost of small diameter circular cutting elements by cutting them, for example by electric discharge machining, from a larger diameter circular blank. FIG. 3 illustrates how such a large diameter circular blank may be used to produce a number of cutting elements in accordance with the present invention with little or no wastage of material, so as to give the lowest possible cost for the elements produced.

The basic circular blank produced in the conventional high pressure forming process is indicated at 42 and may be, for example, 38 mm or 50 mm in diameter. A central circular portion, indicated at 43, is cut from the centre of the blank and concentric therewith by electric discharge machining or other suitable cutting process. This circular portion is cut to such a diameter that it may be used in conventional manner on a drill bit of a type using such circular preforms. For example its diameter may be 13.3 mm, 19 mm or 25 mm.

After the circular centre portion has been removed, the remaining annulus is cut into sections by a plurality of generally radially extending cuts so as to provide a number of similarly shaped preforms. For example, one such preform is indicated at 44 and comprises an inner concavely curved edge 45, an outer convexly curved edge 46 and two radially extending straight side edges 47. The concavity of the inner edge 45 constitutes the re-entrant portion according to the present invention, so that the corners at the ends of the concave portion 45 form projections. The cutting element, in use, is mounted so that these projections act on the formation being drilled.

If required the section may be further shaped after having been cut from the annulus. For example a segment may be removed from the convex outer edge of the section, as indicated in dotted lines at 48, so that the outer edge of the preform is straight.

Instead of being straight, the side edges 47 of each section may be of other shapes as shown in the alternative forms of preform indicated at 49 and 50. As may be seen, the side edges of the sections may be shaped to provide further re-entrant portions and projections in accordance with the invention. Although three different types of preform are shown in FIG. 13, in practice all the preforms cut from an annulus are likely to be similar in shape and symmetrically arranged around the annulus.

It will be appreciated that this method makes virtually total use of the material of the original large circular blank so as to provide preforms at minimum cost.

I claim:

1. A rotary well drill bit comprising a bit body having an end face, a shank for connection to a drill string, an inner channel for supplying drilling fluid to said face and a plurality of cutting elements carried at various radial distances from the centerline of the bit body on said end face, at least some of said cutting elements each comprising a tablet having a front face, a rear face and a peripheral edge, said tablet including a front cutting layer of superhard material defining said front face, said front cutting layer bonded to a less hard backing layer defining said rear face, the front layer being continous and coextensive with the backing layer along the peripheral edge, and said peripheral edge of said tablet being formed with at least two re-entrant portions which define between them a projecting cutting portion comprised of continous coextensive projecting portions of both said layers; and wherein the radius of the end face of the bit body is several times larger than the maximum transverse dimension of the front face of one of said cutting elements.

2. A cutting element according to claim 1, wherein the tablet is formed, along a part of the peripheral edge thereof, with a plurality of alternate re-entrant and projecting portions so as to provide at least three projecting portions.

3. A cutting element according to claim 2, wherein the extremities of all the projecting cutting portions lie on a substantially straight line so that, in use of the cutting element, they act simultaneously on the formation being drilled.

4. A cutting element according to claim 2, wherein the extremities of only some of the projecting portions lie on a substantially straight line, the extremities of at least one other projecting portion being displaced from said straight line.

5. A rotary drill bit according to claim 1, wherein said cutting elements include at least one group of elements in which the relative positions of said cutting elements on different portions of the surface of said bit body are such that the paths swept by the projecting cutting portions of said cutting elements in said group are immediately adjacent one another to ensure removal of formation over a continuous area by said group of cutting elements.

6. A PDC type cutting element for a rotary well drill bit, comprising a tablet having a front face, a rear face and a peripheral edge, said tablet including a front cutting layer of polycrystalline diamond material defining said front face, said front cutting layer bonded to a less hard backing layer defining said rear face, the front layer being continuous and coextensive with the backing layer along the peripheral edge, and said peripheral edge of said tablet being formed with at least two re-entrant portions which define between them a projecting cutting portion comprised of continous coextensive projecting portions of both said layers.

7. A PDC type cutting assembly for use on a well drill bit, comprising a cutting element mounted on a post-shaped carrier, said cutting element comprising a tablet having a front face, a rear face and a pheripheral edge, said tablet including a front cutting layer of polycrystalline diamond material defining said front face, said front cutting layer bonded to a less hard backing layer defining said rear face, the front layer being continuous and coextensive with the backing layer along the peripheral edge, said rear face of said cutting element being bonded to said post-shaped carrier adjacent one end thereof, and said peripheral edge of said tablet being formed with at least two re-entrant portions which define between them a projecting cutting portion comprised of continous coextensive projecting portions of both said layers.

8. A cutting element, for a rotary drill bit, comprising a tablet having a front face, a rear face and a peripheral edge, said tablet including a front cutting layer of superhard material defining said front face, said front cutting layer bonded to a less hard backing layer defining said rear face, and said peripheral edge of said tablet being formed with at least two re-entrant portions which define between them a projecting cutting portion, wherein the entirety of the peripheral edge of the cutting element, apart from said re-entrant portions, is part-circular in configuration.

* * * * *